US005675854A

United States Patent [19]

Zibelin

[11] Patent Number: 5,675,854

[45] Date of Patent: Oct. 14, 1997

[54] MATTRESS APPARATUS

[76] Inventor: Henry S. Zibelin, 1423 26th St., NW., Winter Haven, Fla. 33881

[21] Appl. No.: 774,230

[22] Filed: Dec. 27, 1996

[51] Int. Cl.[6] ..... A47K 1/02

[52] U.S. Cl. ..... 5/695; 5/604; 5/606; 5/731

[58] Field of Search ..... 5/722, 731, 695, 5/652.1, 604, 606

[56] References Cited

U.S. PATENT DOCUMENTS

| | | | |
|---|---|---|---|
| 702,511 | 6/1902 | Turney et al. | 5/606 |
| 2,924,832 | 2/1960 | Knowles | 5/90 |
| 3,023,429 | 3/1962 | Borotra | 5/90 |
| 3,093,836 | 6/1963 | Christensen et al. | 5/606 |
| 4,620,333 | 11/1986 | Ritter | 5/90 |
| 4,718,653 | 1/1988 | Rothman | 5/606 |
| 4,725,270 | 2/1988 | Schuldt et al. | 604/356 |
| 4,752,293 | 6/1988 | Smith | 5/695 |
| 4,870,710 | 10/1989 | Hartmann | 5/90 |
| 5,355,540 | 10/1994 | Allen | 5/604 |

*Primary Examiner*—Steven N. Meyers
*Assistant Examiner*—Fredrick Conley
*Attorney, Agent, or Firm*—William M. Hobby, III

[57] ABSTRACT

A mattress apparatus for incontinent patients includes first and second resilient mattress portions each having a sloping end and a water repellent cover attached thereover. The covers are removably attached together to form a mattress. A liquid drain cover is made of a flexible, water repellent material and has first and second sections and is shaped to fit over the connected first and second resilient mattress portions. Each section of the liquid drain cover has a plurality of elongated ridges extending thereover and forming a plurality of drain grooves therebetween. The drain cover has a liquid collection channel formed between the first and second sections for collecting liquid draining from. The liquid collection channel located between the drain cover sections is connected to a liquid collection container for collecting liquid from the channel. The drain cover has a beaded edge around three sides of each section to block the escape of liquid therefrom. An alternative embodiment has first and second resilient body support members having a plurality of ridges and valleys formed therein. Another embodiment has an air tube located in the drain cover grooves so that air escaping from openings in the tube cools and dries the patient using the mattress. Vacuum tubes are also used to remove collected liquid on the drain cover.

18 Claims, 6 Drawing Sheets

MATTRESS APPARATUS

BACKGROUND OF THE INVENTION

The present invention relates to a mattress for incontinent bed ridden persons and for removing accumulations of body liquids from the surface of the mattress.

In the past, incontinent bed ridden persons have generally been placed on liquid impervious pads used over mattresses and sheets which has allowed substantial accumulations of body liquids in contact with the bed ridden person's body until such pads can be cleaned. Accumulations of body liquids with the skin for prolonged periods poses a danger of irritation and infection to the patient. It thereby becomes important that discharged body liquids be collected promptly and removed from contact with the incontinent person. To achieve this without repeated changes of the bedding, various systems have been proposed to collect the body liquids and draw them off from beneath the patient.

Typical prior art systems for collecting and removing body fluids from an incontinent or bed ridden patient's mattress include the Schuldt et al. U.S. Pat. No. 4,725,270, for a fluid channeling pad which includes a channel built into the pad forming a trough for removal of fluids. In addition, this pad has a perimeter which may extend upwardly to form a channel to control the flow of liquids from the edge of the pad. In the Hartmann U.S. Pat. No. 4,870,710, a body liquid collecting and mattress protecting system is provided for collecting body liquids and includes a liquid impervious laminated mattress pad having a tube accessed from the upper surface of the pad through holes to continuously draw off fluids through the tube into a container. In the Allen U.S. Pat. No. 5,355,540, a bed for patients requiring bed treatment has a cutout in the base beneath which a toilet pan is placed. A mattress having a quarter removed, is positioned on the base with the open quadrant over the pad which can be easily removed from below the mattress. The Knowles U.S. Pat. No. 2,924,832, is a sanitary bed having an opening collecting center portion therein for collecting body fluids. The Ritter U.S. Pat. No. 4,620,333, is an incontinent bed facility in which a liquid discharge unit has a toilet tray with drainage at the bottom of the tray placed under a non-corrosive nylon net positioned in the middle of a mattress and covering foam blocks. Liquids passing into the open area are collected and passed to a container. The Henriette Borotra U.S. Pat. No. 3,023,429, has a mattress having an opening in the center with a funnel-like attachment covering the opening for receiving body liquids therein.

In contrast to these prior art patents, the present mattress for incontinent patients has water repellant covers which assist the direction of flow of body fluids into a center channel with each cover having a plurality of ridges. The ridges in the cover provide for the comfort of the patient but at the same time tend to direct the fluid between the ridges along angled surfaces into a center channel where the fluid is taken off through a tube to a container. The present invention also provides for drying and cooling the patient with flexible resilient tubes placed between the ribs and having forced air pushed through opening slits placed in the tube.

SUMMARY OF THE INVENTION

A mattress apparatus for incontinent patients includes first and second resilient mattress portions each having a sloping end and a water repellent cover attached thereover. The covers are removably attached together to form a mattress. A liquid drain cover is made of a flexible, water repellent material and has first and second sections and is shaped to fit over the connected first and second resilient mattress portions. Each section of the liquid drain cover has a plurality of elongated ridges extending thereover and forming a plurality of drain grooves therebetween. The drain cover has a liquid collection channel formed between the first and second sections for collecting liquid draining from. The liquid collection channel located between the drain cover sections is connected to a liquid collection container for collecting liquid from the channel. The mattress cover has a beaded edge around three sides of each section to block the escape of liquid therefrom. An alternative embodiment has first and second resilient body support members having a plurality of ridges and valleys formed therein. Another embodiment has an air tube located in the drain cover grooves so that air escaping from openings in the tube cools and dries the patient using the mattress. Vacuum tubes are also used to remove collected liquid on the drain cover.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figures 1, 2:
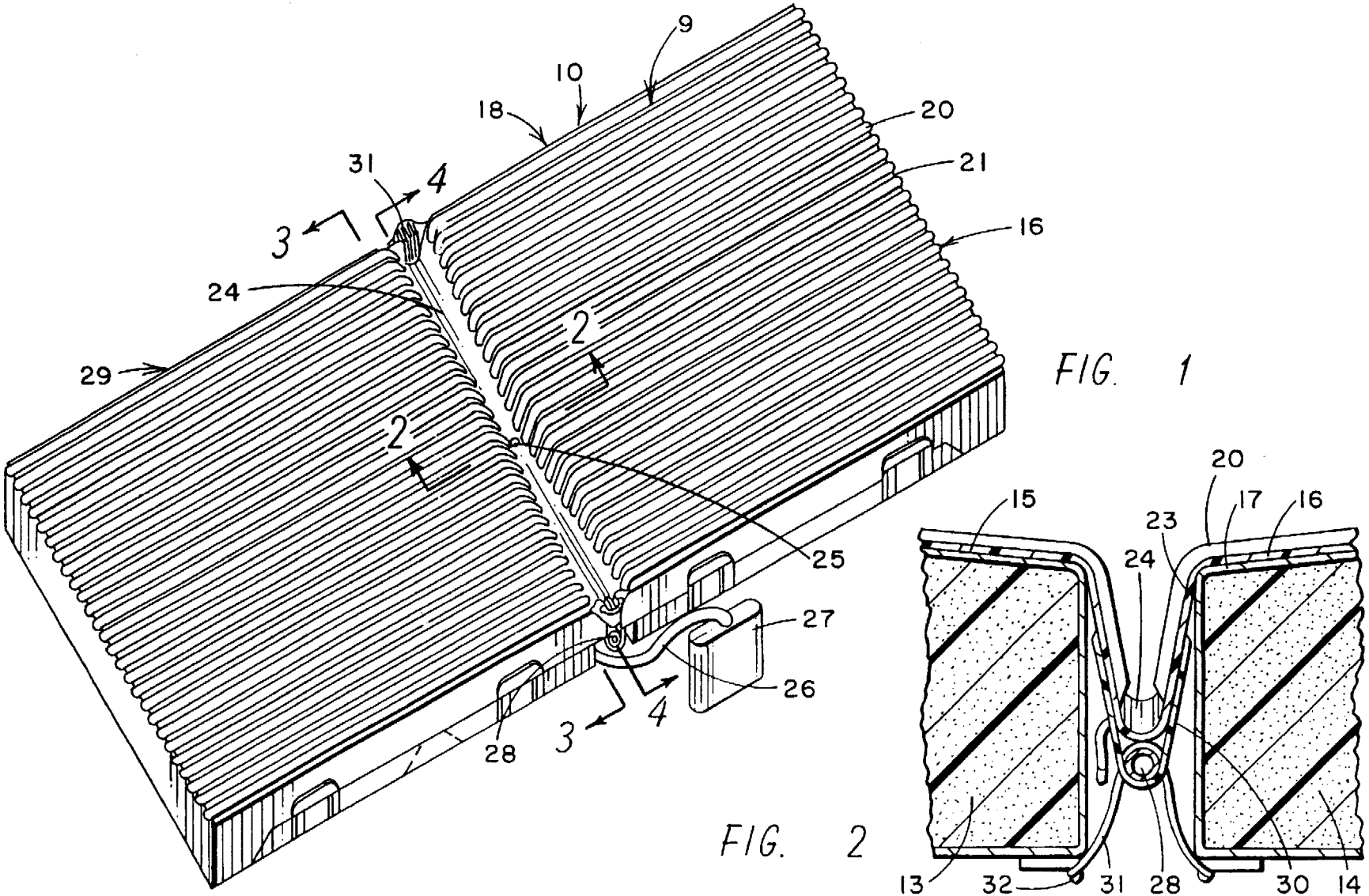
FIG. 1 is a perspective view of a mattress in accordance with the present invention.
FIG. 2 is a sectional view taken on line 2—2 of FIG. 1.

Referring to the drawings and especially to FIGS. 1–6, a mattress 10 for incontinent patients is illustrated having a mattress portion 11 and a mattress portion 12 which are held together by the drain cover 9 (FIG. 1A) extending over both mattress portions. The mattress portion 11 is formed of a resilient polymer foam block 13, such as a foamed polyurethane block and the mattress portion 12 is formed with the resilient polymer foam 14. Each polymer foam piece 13 has a sloping end portion 15 while the polymer foam portion 14 has a sloping end portion 16. The mattress portions 11 has a water repellant drain cover 17 held thereover with a zipper 42. The mattress portion 12 has a water repellant cover 19. The drain cover 9 has a plurality of elongated ridges 20 formed thereon to thereby form a plurality of drain grooves 21 therebetween. The ridges 20 can be formed of a polymer foam but can also be hollow tubes filled with air or water or the like to form the ridges in the drain cover. Each of the elongated drain cover ridges 20 runs the length of each mattress portion 11 and 12 and across the sloping portion 15 and 16 of each mattress portions and bending over the ends 23 of the mattress portions. The drain cover 9 has the ridges 16 extending over the sloped portion and over the inside edge 23 and into a collection area 24 formed by the center portion of the drain cover 9 sections 18 and 29. The liquid collection area 24 has a drain opening 25 in the center thereof with a drain tube 26 extending therefrom for the drainage of liquid from the collection area to a collection container 27. The center collection area 24 has a stainless steel tube 28 mounted to the collection area 24 with elastic fastener members 30 and also has the elastic fastener members 31 extending therearound and attached to tabs 32 on the mattress covers 17 and 19. The two mattress sections 11 and 12 may be held together with fasteners, such as hook and loop fasteners 38 and 40 attached to the mattress covers 17 and 19. The foamed polymer block 13 has a knee bend cut 37 formed therein while the block 14 has a shoulder cutouts 39.

Figure 1A:
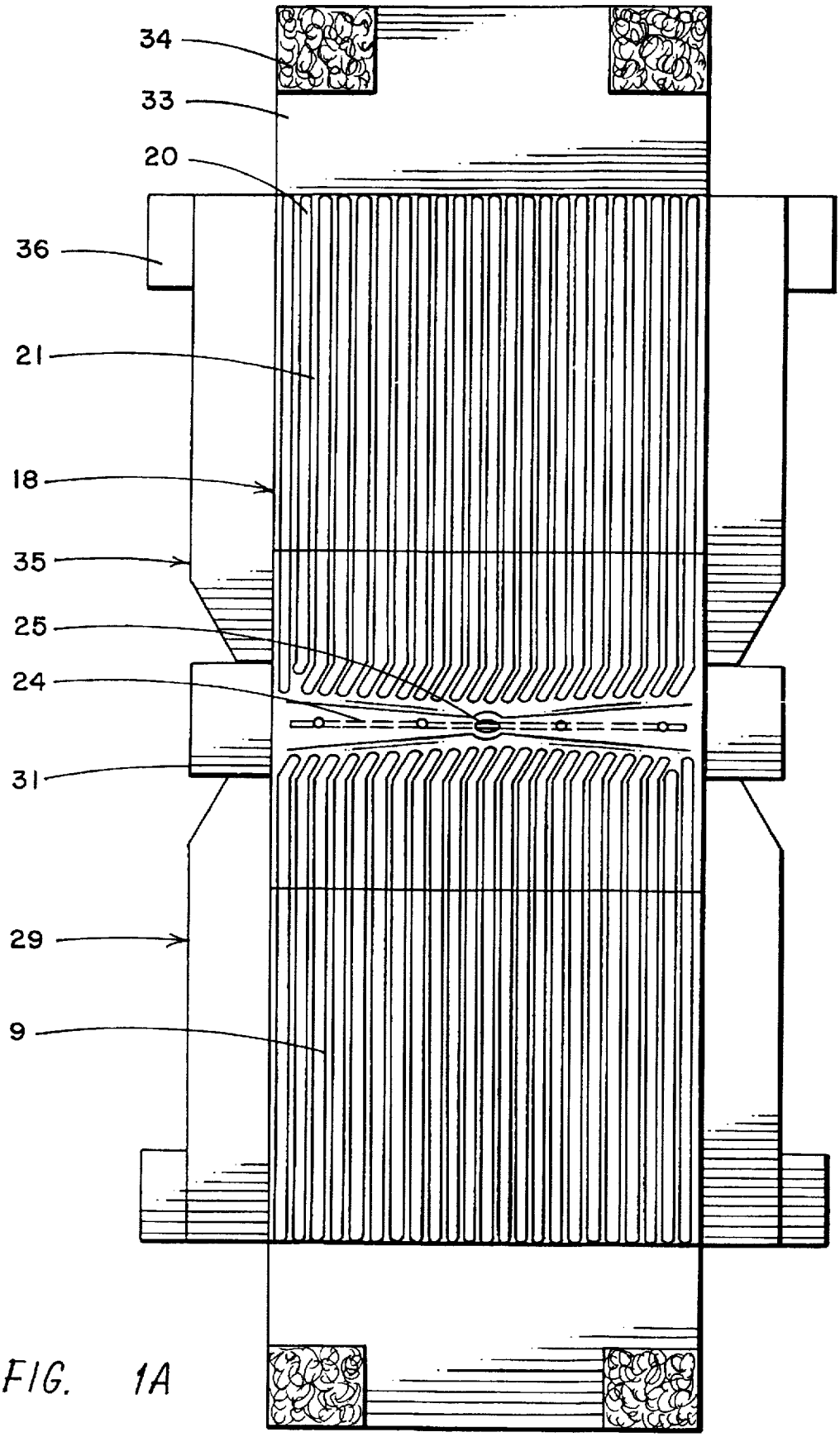
FIG. 1A is a top plan view of the mattress drain cover of FIG. 1.
Figure 3:
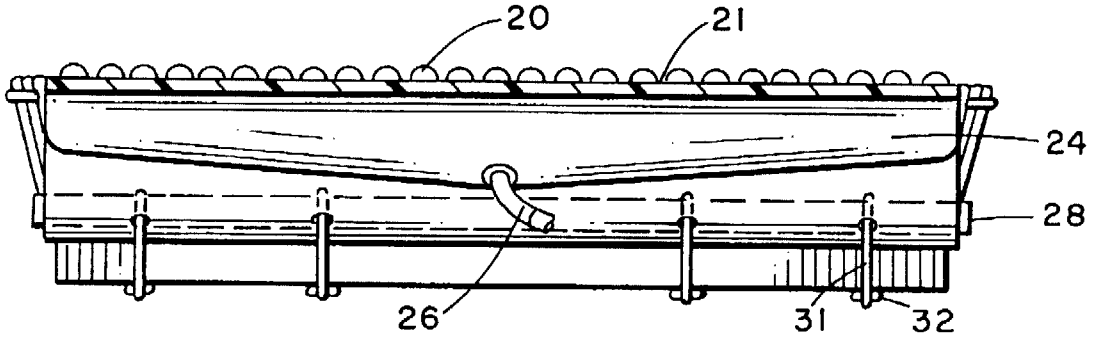
FIG. 3 is a sectional view taken on line 3—3 of FIG. 1.
Figure 4:
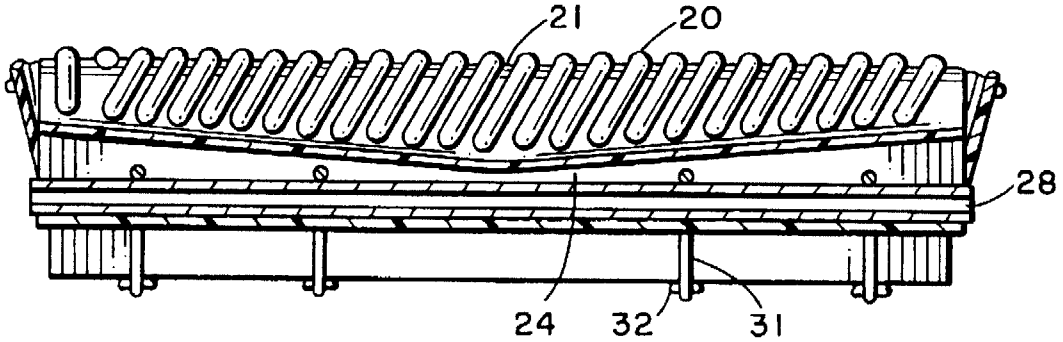
FIG. 4 is a sectional view taken on line 4—4 of FIG. 1.
Figure 6:
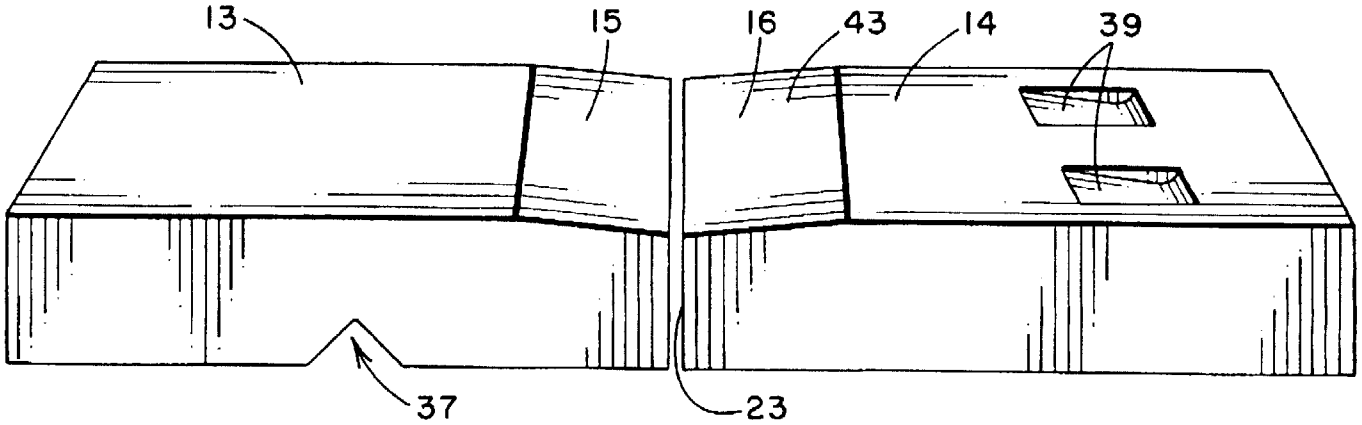
FIG. 6 is a perspective view of uncovered mattress portions of the mattress of FIGS. 1 through 5.
Figure 5:
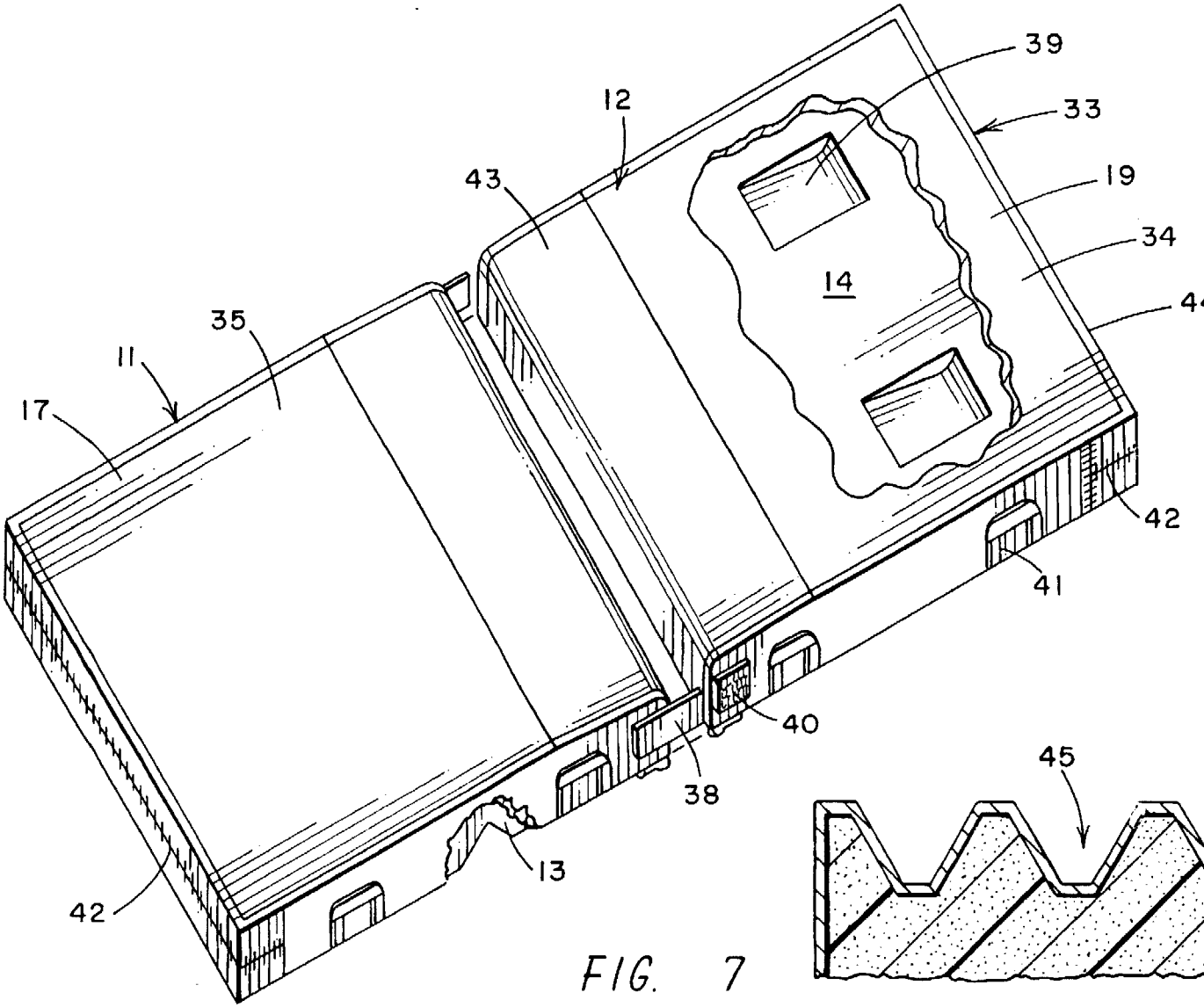
FIG. 5 is a perspective view of the mattress sections having the cover removed therefrom.

The drain cover 9, as seen in FIG. 1A has two sides 18 and 29 having the drain ridges 20 and grooves 21 connected by the collection area 24 having the drain opening 25 therein. The drain cover has end wrap portions 33 each having hook and loop fasteners 34 thereon and side wrap portions 35 having hook and loop fastener portions 36 extending therefrom. Placing the drain cover 9 over the mattress portions 11 and 12 with the liquid collection area 24 therebetween and then folding the end wrap portions 33 around the ends of the mattress portions 11 and 12 positions the hook and loop material 34 for attachment to the hook and loop material 36 when side wrap portions 35 are wrapped around the ends and sides of the mattress portions 11 and 12. The center tabs 31 are folded together when the drain cover 9 is attached to the mattress portions and may be clipped in a folded position to prevent any escape of liquid from the collection area 24. The covers are formed with a raised lip 44 extending around three edges thereof. The raised lip 44 prevents the escape of body fluids from the edges of the mattress so that the liquid is directed by the slopes 15 and 16 into the collection area in the center between the mattress portions 11 and 12.

In operation, a patient is supported across both mattress portions 11 and 12 with the upper body supported on one end and the lower body and legs supported on the opposite end. Fluids escaping from the patient are captured in the various grooves 21 formed by the raised ridges 20 on the waterproof cover 29 and are directed by the slopes 15 and 16 in the middle portion of the connected mattress portions into the collection area 24 where they are directed towards the outlet opening 25 and drain tube 26 and into the collection container 27. The resilient drain cover 9 can be made of a waterproof flexible material, such as GORE-TEX.

Figure 7:
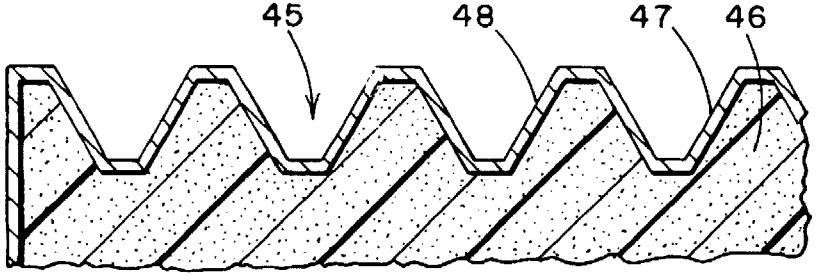
FIG. 7 is a sectional view of another alternate embodiment of a mattress in accordance with the present invention.

Referring to FIG. 7, an alternate embodiment of a mattress 45 for incontinent patients is illustrated having a resilient polymer foam mattress portion 46 having deep grooves 47 formed therein to replace the channels in the cover of the previous embodiment, as illustrated in FIG. 1 through 6. A flexible resilient cover 48 is form fitted to the grooves 47 and may be adhesively attached thereto. This embodiment can be used to direct body fluids to a center drain portion as shown in FIGS. 1–6.

Figure 8:
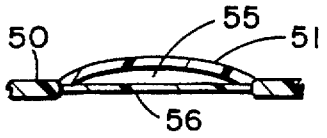
FIGS. 8 is a sectional view of a drain ridge bending area of the drain cover of FIG. 1.
Figure 9:
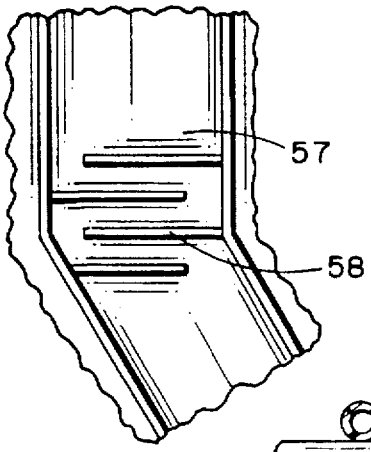
FIGS. 9 is a sectional view of a drain ridge bend area of the drain cover for the mattress of FIG. 1.

Turning now to FIGS. 8 and 9, one embodiment is illustrated for the drain ridges and valleys of the mattress drain cover 9 to bend over the edge of each mattress portion 11 and 12 without the ridges crimping or bending out of shape or becoming rigid due to air pressure in ridges when filled with air. The cover has a flexible resilient waterproof covering material 50 having a plurality of raised ridges 51 in FIG. 8 forming an air space 55 thereunder in a sealed tube formed with the bottom surface 56. The ridges 51 may be filled with any fluid desired such as a liquid, gas or foamed polymer and are filled under enough pressure to support a patient's body weight. As shown in FIG. 9 the ridges of FIG. 8 are shaped for a bend of about 30 degrees with the tubes 57 having the ribs 58 positioned therein. Sealed seams form each rib where the ribs turn down between the mattress sections.

Figure 10:
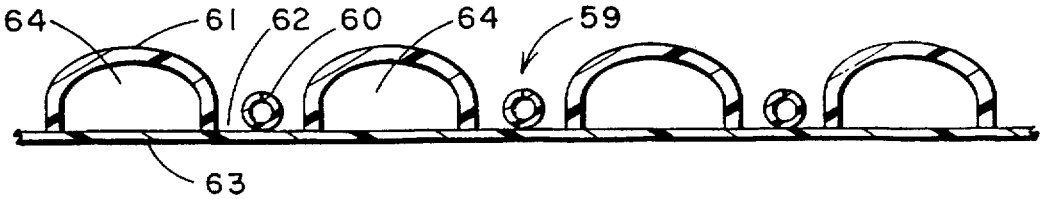
FIG. 10 is a sectional view of an alternate embodiment of the present invention having air tubes placed between drain ridges.
Figure 11:
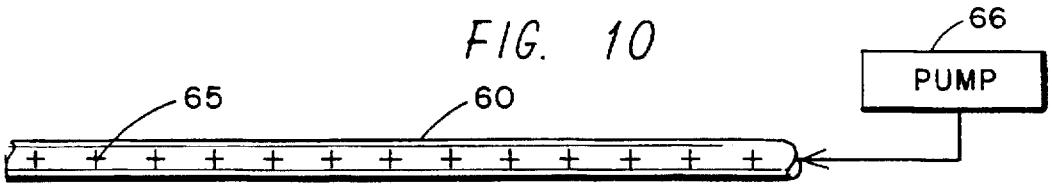
FIG. 11 is a diagrammatic view of one air tube of FIG. 10 having a connected air pump.

Turning now to FIGS. 10 and 11 an embodiment of the drain cover 59 has air tubes 60 passing between the ridges 61 in the grooves 62 attached to the drain cover 59 base 63. Each ridge 61 has a hollow center 64 and may be filled with air under pressure or with a foamed polymer or any supporting liquid or gas desired. The tube 60, as illustrated in FIG. 11, has a plurality of slits 65 which may be cross-cut as shown and the tube 60 and is connected to a pump 66 which places air under pressure in the tube 60 to force air through the slits 65 for drying the patient and the mattress cover when the tubes 60 are positioned over the drain cover and are also used for cooling the patient using the mattress.

Figure 12:
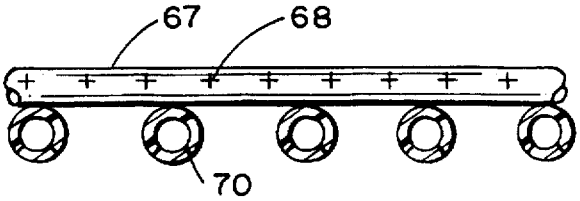
FIG. 12 is a sectional view of another embodiment of air tubes having air tubes under pressure criss-crossed with vacuum tubes for removing fluid collected adjacent the mattress cover.
Figure 13:
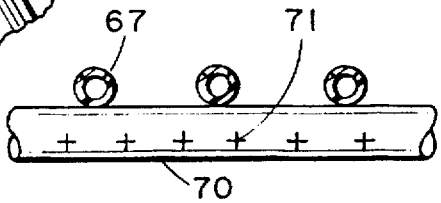
FIG. 13 is a sectional view of the embodiment of FIG. 12.
Figure 14:
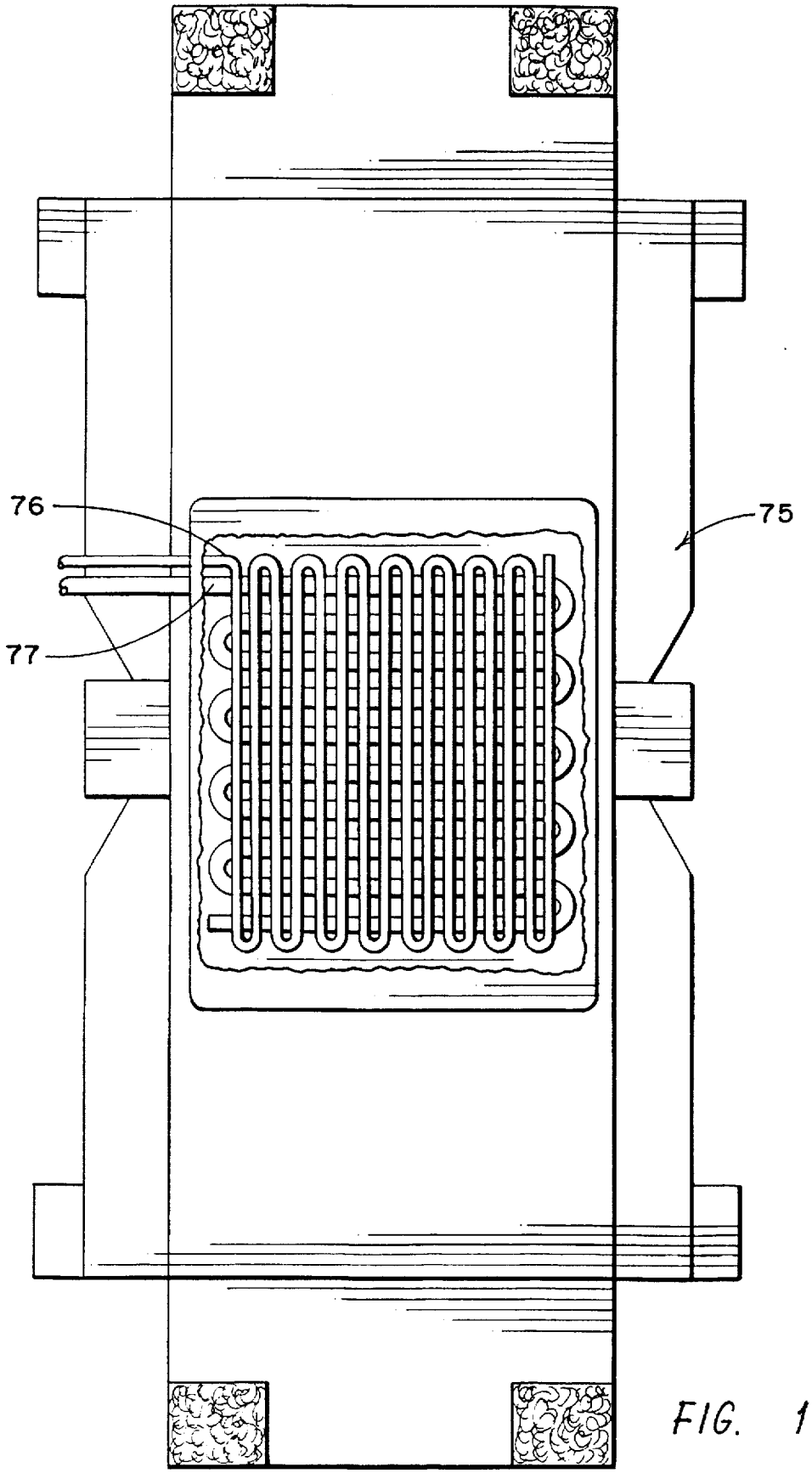
FIG. 14 is a top plan view of a mattress drain cover incorporating the air and vacuum tubes of FIGS. 11 and 12.

FIGS. 12, 13 and 14 show another embodiment of a mattress drain cover with air drying tubes 67 having slits 68 therein and criss-crossed with vacuum tubes 70 having slits 71 therein. The air tubes 67 are used to cool and dry the patient and the drain cover while the vacuum tubes 70 are used to remove accumulated fluid on the mattress drain cover. FIG. 14 shows a mattress drain cover 75 which is similar to the drain cover shown in FIG. 1A but having the air pressure tubes 76 criss-crossed with the vacuum tubes 77 placed thereover. In practice a felt mat 78, or the like, would be placed over the tubing for the patient's comfort. Air under pressure in tubes 76 is directed upwardly while the opening in the vacuum tubes 77 face downward to dry the drain cover and remove excess fluids from the drain cover.

Figure 15:
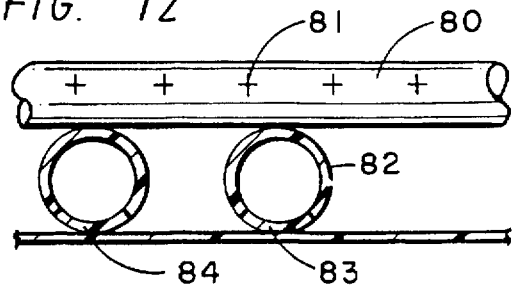
FIG. 15 is a sectional view of an embodiment of the tubing of FIG. 12 having the tubing attached to the mattress cover.

FIG. 15 is another embodiment of the crossing tubes illustrated having tube 80 having a plurality of star cuts 81 therein and having air under pressure in the tube 80 which is dispersed through the cuts 81 for drying the patient. A plurality of vacuum tubes 82 have a negative pressure placed thereon and have a plurality of star cuts 83 therein along the bottom thereof for removing liquid from the mattress cover 84. The tubes 82 are attached to the mattress cover 84, such as by diaelectrically sealing portions of the tube 82 to the cover 84. The tubes 80 may also be attached to the tubes 82. This allows the tubing configuration, as shown in FIG. 15, to be placed on a regular hospital bed as well as on two piece mattresses formed of polymer foam, as illustrated herein. The tubing 80 and 82 can be covered with a nylon fiber mat to protect the patient.

Figure 16:
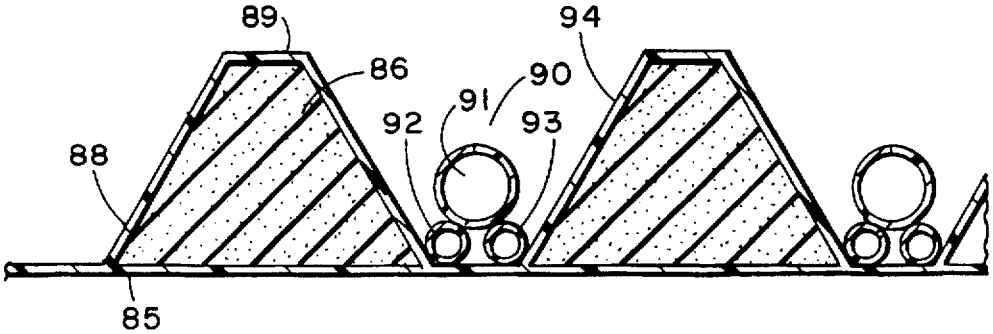
FIG. 16 is a sectional view of an embodiment having air tubes and vacuum tubes placed in mattress grooves.

FIG. 16 shows another embodiment of a drain cover section having a mattress drain cover 85 having a plurality of ridges 86 which are made of a polymer foam which can have a higher density to give increased firmness to the foam attached to the cover 85. Each foam ridge 86 has a cross-section having a flat top portion 87 and two angled sides 88 so that parallel rows of the ridges 86 form valleys 90 having air tube 91 for receiving air under pressure which is dispersed through small cuts in the tube to cool and dry a patient by aerating underneath the patient and evaporate and liquid. The air tube 91 sits on two vacuum tubes 92 and 93 placed at the bottom of the valley 90. Tubes 92 and 93 each have a plurality of cuts therein for drawing a vacuum adjacent the bottom of each valley 90 to remove liquids accumulating in the valleys. Each foam ridge 86 can also have a waterproof surface 94 thereon. A patent laying on top of the mattress cover 85 would be supported on top of the foam ridges 86 and waste fluids would accumulate in the valleys 90 where they would be absorbed through the suction tube 92 and 93 while the air pressure tube 91 would aerate beneath the patient to dry and cool the patient.

It should be clear at this time that a mattress for incontinent patients has been provided which helps direct the fluids from a person on a mattress away from the patient and into a collection container which also provides for the cooling and drying of the patient with the addition of positive air forced through vented air tubes and negative air pressure in drain tubes. However, the present invention should not be considered limited to the forms shown which are to be considered illustrative rather than restrictive.

I claim:

1. A mattress for incontinent patients comprising:

a first resilient mattress portion having top and bottom sides and having first and second end portions, said first end portion having an angled surface, said first resilient mattress portion having a water repellent cover;

a second resilient mattress portion having top and bottom sides and having first and second end portions said first end portion having an angled surface, said second resilient mattress portion having a water repellant cover;

a plurality of attaching members for removably attaching said first and second resilient mattress portions together to form a body supporting mattress;

a liquid drain cover made of a flexible, water repellent material and shaped to fit over said connected first and second resilient mattress portions, said liquid drain cover having first and second sections, each section having a plurality of elongated ridges extending thereover and forming a plurality of drain grooves therebetween, said drain cover having a liquid collection channel formed between said liquid drain cover first and second sections for collecting liquid draining from said drain cover grooves; and a liquid collection container connected to said liquid drain cover collection channel to receive liquid from said liquid collection channel, whereby a bedridden patient's urine is directed from each said drain cover section into said collection channel and collection container.

2. A mattress for incontinent patients in accordance with claim 1 in which said drain cover plurality of ridges are formed of a foamed polymer.

3. A mattress for incontinent patients in accordance with claim 1 in which said plurality of ridges are formed of a foamed polyurethane.

4. A mattress for incontinent patients in accordance with claim 2 in which said drain cover liquid collection channel has a stainless steel tube connected thereunder and attached thereto.

5. A mattress for incontinent patients in accordance with claim 2 in which said first and second resilient mattress portions are each formed of a foamed polymer.

6. A mattress for incontinent patients in accordance with claim 5 in which each said foamed polymer resilient mattress portion is polyurethane.

7. A mattress for incontinent patients in accordance with claim 1 in which said liquid drain cover is made of a flexible waterproof fire retardant polymer.

8. A mattress for incontinent patients in accordance with claim 1 in which said first and second water repellant cover each have a zipper thereon for sealing each said cover over one resilient mattress portion.

9. A mattress for incontinent patients in accordance with claim 1 in which each said liquid drain cover section plurality of ridges extend over one end of each said first and second resilient mattress portion.

10. A mattress for incontinent patients in accordance with claim 1 in which said plurality of attaching members are hook and loop fasteners.

11. A mattress for incontinent patients in accordance with claim 1 having a flexible tube connecting said liquid collection channel and said liquid collection container.

12. A mattress for incontinent patients in accordance with claim 1 in which each said liquid drain cover liquid collection channel has edge tabs at each end thereof to prevent escape of liquid collected in said liquid collection channel.

13. A mattress for incontinent patients in accordance with claim 4 including a plurality of tube fasteners connected between said stainless steel tube and each said first and second resilient mattress portion water repellant cover to hold said stainless steel tube and liquid collection channel in place between drain cover first and second sections.

14. A mattress for incontinent patients in accordance with claim 1 in which each said first and second resilient mattress portions water repellant covers has a plurality of handles attached thereto.

15. A mattress for incontinent patients in accordance with claim 1 in which each said drain cover first and second sections has a beaded edge around the periphery of three sides thereof.

16. A mattress for incontinent patients in accordance with claim 1 including a air tube having a plurality of opening therein positioned in said drain cover grooves and said air tube being connected to a source of pressurized air for forcing air through said tube and through said plurality of openings in said tube whereby forced air cools a patient and dries moisture collected on said drain cover.

17. A mattress for incontinent patients in accordance with claim 16 in which said air tube has a plurality of star cuts therein.

18. A mattress for incontinent patients in accordance with claim 16 including a vacuum tube positioned on said drain cover and having a negative pressure place thereon for removing liquid collected on said drain cover.

* * * * *